United States Patent [19]

Kobayakawa et al.

[11] 4,047,066

[45] Sept. 6, 1977

[54] FLAT DISPLAY PANEL COMPRISING AN ENVELOPE INCLUDING A SUBSTRATE HAVING TERMINAL-RECEIVING GROOVES

[75] Inventors: Masaki Kobayakawa; Fumitake Akahane, both of Kagoshima, Japan

[73] Assignee: Nippon Electric Kagoshima, Limited, Kagoshima, Japan

[21] Appl. No.: 661,447

[22] Filed: Feb. 25, 1976

[30] Foreign Application Priority Data

Feb. 27, 1975 Japan ..... 50-24789

[51] Int. Cl.[2] ..... H01J 61/06

[52] U.S. Cl. ..... 313/217; 313/220

[58] Field of Search ..... 313/217, 220, 188, 201

[56] References Cited

U.S. PATENT DOCUMENTS 3,821,586 6/1974 Ogle ..... 313/217 X

*Primary Examiner*—Rudolph V. Rolinec

*Assistant Examiner*—Darwin R. Hostetter

[57] ABSTRACT

A flat display panel comprises a planar substrate as a part of a hermetically sealed envelope. Electrode end pieces connected at least to predetermined ones of the electrodes for display are fixed to the substrate. A plurality of grooves are formed in the substrate and snugly receive a predetermined portion of terminals connected to the respective end pieces and extended outwardly of the envelope for connection to an external circuit for driving the display panel. Preferably, the grooves have sloping end surfaces along which the respective terminals are partly extended.

8 Claims, 3 Drawing Figures

FLAT DISPLAY PANEL COMPRISING AN ENVELOPE INCLUDING A SUBSTRATE HAVING TERMINAL-RECEIVING GROOVES

BACKGROUND OF THE INVENTION

This invention relates to a flat display panel that may be a flat fluorescent or phosphorescent display panel, a flat gas discharge display panel, or a flat plasma display panel, and comprises as a part of a hermetically sealed envelope a planar substrate of an insulating material, such as glass or ceramic. The display panel is for use together with an external circuit for making the panel display a selected one of a plurality of displays. A display, of course may comprise a plurality of numerals, letters, and symbols.

A display panel of the type described comprises a plurality of electrodes for the plurality of displays in a space enclosed within the envelope. It is assumed without loss of generality that the display panel is for dural digit numerals. The substrate has an internal surface facing the space. The electrodes comprise segmented electrodes either on the internal surface or in indentation formed in the substrate in a substantially figure-eight configuration for each digit. If the display panel is a fluorescent display panel the electrodes further comprise one or more hot cathodes in front of the segmented electrodes and grids for the respective digits between the cathodes and the segmented electrodes. The cathodes are held by a pair of metal blocks fixedly attached to the substrate. The grids are supported by similar blocks. The blocks are called conductive end pieces herein. Terminals or lead wires are connected to the respective end pieces and led out of the space.

In general, further terminals, equal in number to the segmented electrodes for each digit, are connected to all segmented electrodes and extended outwardly of the envelope. Although no specific metal blocks are used to connect the terminals to the segmented electrodes, those ends of the terminals which are brought into contact with the segmented electrodes may be called conductive end pieces for convenience of description. These terminals extend at least partly along the internal surface. If the display panel is a gas discharge display panel, the electrodes further comprise transparent electrodes opposing the segmented electrodes of the respective digits with the space interposed therebetween. Connection means are conductively attached to all electrodes and disconnectively connected to the external circuit when the display panel is to be put into operation. The connection means includes terminals or leads conductively attached to conductive end pieces for the segmented electrodes and extended along the internal surface and through the envelope. Besides the segmented electrodes, the end pieces for the cathodes and grids may be made integral with the respective terminals. Each terminal extending at least parly along the internal surface generally consists of two portions, respectively deemed herein a terminal member and a connection piece.

In one type of the display panels, the terminal members are manufactured simultaneously and integrally with the connection pieces by applying silver paste onto the internal surface and its extension by the use of printing techniques. A display panel of this type has been objectionable with respect to its reliability because short circuit occur between the terminal members due to migration of silver when electric power is supplied to the terminals from the external circuit in a highly moist atmosphere. In another type of the display panels, the terminal members are rod-shaped leads of a metal, such as "426 Alloy", capable of being hermetically sealed in a mass of frit glass. In order to be sealed in the frit glass mass, the rod-shaped terminal members have to be thin so as to be better named "strip-shaped" leads or terminal members. When the number of the terminals are relatively large as in the case of a multi-digit display panel, the terminal members have to be as thin as 0.1–0.2 mm. In any event, it has been inevitable that the terminal members are defective in their mechanical strength. Furthermore, the "426 Alloy" is expensive. It has consequently been unavoidable that the display panels of the latter type are high-priced even when the substrates are made of glass to reduce the price.

SUMMARY OF THE INVENTION

It is therefore an object of the present invention to provide a flat display panel that is reliable even when used in a highly moist atmosphere.

It is another object of this invention to provide a flat display panel of the type described, which has mechanically strong terminals or lead wires.

It is still another object of this invention to provide a flat display panel of the type described, which is inexpensive.

A flat display panel to which this invention is applicable includes a hermetically sealed envelope and is for use together with an external circuit disposed outwardly of the envelope for causing the display panel to display selected one of a plural of displays at any time. The display panel comprises a planar substrate made of an insulating material, such as glass or ceramic, as a part of the envelope and having an internal surface directed inwardly of the envelope, a plurality of electrodes for the plurality of displays inside of the envelope, and connection means for connecting the electrodes to the external circuit. The connection means, in turn, comprises a plurality of conductive end pieces fixedly attached to the substrate and connected at least to predetermined ones of the electrodes, a plurality of elongated terminals conductively attached to the end pieces and extended outwardly of the envelope for connection to the external circuit, and fixing means fixing the terminals to the substrate at predetermined portions of the respective terminals. For a fluorescent or phosphorescent display panel, the end pieces are attached to all electrodes of the panel. The fixing means may be a portion of the envelope.

In accordance with this invention, the substrate is provided with a plurality of grooves substantially snugly receiving the respective predetermined portions of the terminals and having openings on the internal surface. The terminals extended through the respective openings.

DESCRIPTION OF THE PREFERRED EMBODIMENTS

Figure 1:
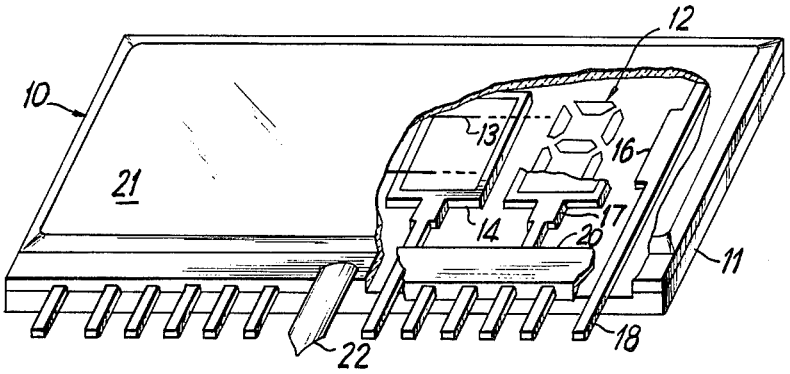
FIG. 1 PRIOR ART
FIG. 1 shows a schematic perspective view of a conventional flat display panel with parts cut away.

Referring to FIG. 1, a conventional flat display panel will first be described to facilitate an understanding of the present invention. The display panel comprises a hermetically sealed envelope 10 and is for use together with an external circuit (not shown) for making the display panel display a selected one of plural possible displays. In the example being illustrated, the display consists of plural digit numerals. The display panel further comprises a planar substrate 11 formed of glass as a part of the envelope 10 and has an internal surface directed inwardly of the envelope 10 and an extension of the internal surface. The display panel still further comprises a plurality of fluorescent anode segments 12 formed in the internal surface in substantially a figure-eight configuration for each digit, two hot cathodes 13 in front of the anode segments 12, and a plurality of grids 14 for the respective digits. The cathodes 13 are supported by a pair of cathode end pieces 16 fixedly attached to the substrate 11. The grids 14 are respectively held by grid end pieces 17. A plurality of strip-shaped terminals 18 of "426 Alloy" are arranged on the internal surface and extended outwardly of the substrate 11 through an extension of the internal surface. Some of the terminals 18 are made integral with the cathode and grid end pieces 16 and 17. Others of the terminals 18 are conductively attached to "end pieces" for the anode segments 12. The terminals 18 are fixed to the substrate 11 with a mass 20 of frit glass. The frit glass mass 20 serves also to hermetically seal a cover glass sheet 21 with the substrate 11. A space enclosed with the envelope is evacuated through an exhaust pipe 22.

Figure 2:
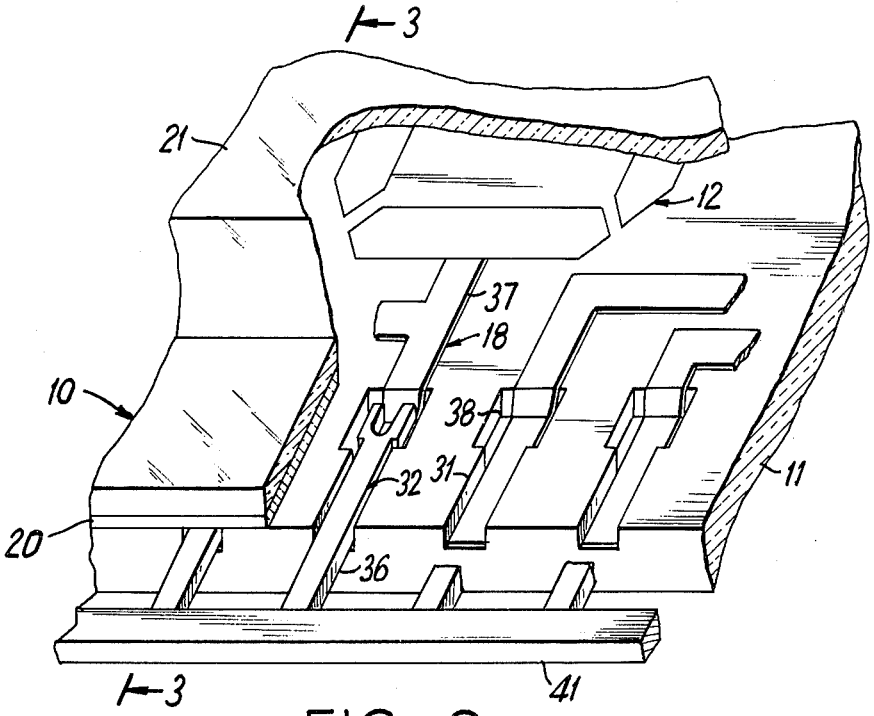
FIG. 2 schematically illustrates a fragmentary perspective view of a flat display panel according to an embodiment of the instant invention with parts removed.
Figure 3:
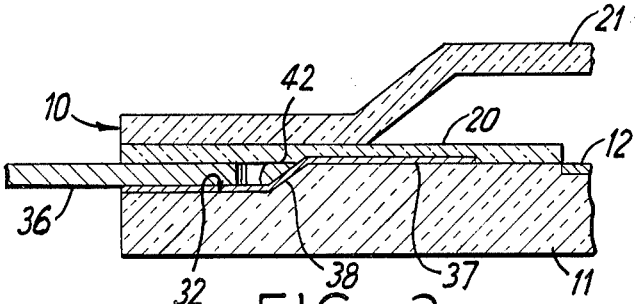
FIG. 3 is a partial vertical sectional view of the display panel depicted in FIG. 2 along a plane shown by a line 3—3 in FIG. 2.

Referring now to FIGS. 2 and 3, a flat display panel according to an embodiment of the present invention is of a similar structure as the conventional one illustrated with reference to FIG. 1. The display panel therefore comprises a hermetically sealed envelope 10, a planar substrate 11, and anode segments 12. Cathodes, grids, and cathode and grid end pieces are not depicted in FIGS. 2 and 3. The display panel further comprises terminals 18, a frit glass mass 20, and a cover glass sheet 21. In accordance with this invention, the substrate 11 is provided with a plurality of grooves 31 substantially snugly receiving predetermined portions 32 of the respective terminals 18. In the example being illustrated, each groove 31 has an opening on the internal surface along the whole length of the groove 31. Each terminal 18 comprises a rod-shaped conductive lead, or terminal member 36 and an internal conductor connection piece 37 having a first end conductively attached to a conductive end piece (not shown in FIGS. 2 and 3) and a second end connected to the terminal member 36. The connection pieces 37 may be formed on the internal surface by applying silver paste onto the surface and partly onto the bottom surfaces of the respective grooves 31 by the use of printing techniques. The connection pieces 37 thus extend through the respective openings.

Each of the grooves 31 has a sloping end surface 38. The second ends of the connection pieces 37 are extend also along the respective sloping end surfaces 38. The sloping end surfaces 38 facilitate manufacture of the connection pieces 37 by the printing techniques. The angle formed by the sloping end surfaces 38 with the internal surface of the substrate 11 is most preferably about 135° or more in order to prevent the connection pieces 37 from tending to break at their second ends. Most preferably, the terminal members 36 are made of the "426 Alloy" and connected together at their corresponding ends by a transverse rod 41 for ease of placing the predetermined portions 32 in the respective grooves 31 in superposition on the second ends of the respective connection pieces 37. Silver paste may be applied, as shown at 42, to the points of superposition and made to solidify by natural or forced desiccation. Upon the predetermined portions 32, the mass 20 of frit glass, preferably LS-0205 frit glass manufactured and sold by Nippon Electric Glass Company, Limited, of Ootu-si, Sigaken, Japan, is applied and fired with the cover glass sheet 21 put in place to fix and hermetically seal the terminals 18 to the substrate 11. The frit glass mass 20 may be extended inwardly of the internal surface to cover the connection pieces 37 in order to protect the silver paste films. Alternatively, the predetermined portions 32 may be fixed to the substrate 11 by merely using cementing material, such as S-14 cement made and sold by Sumitomo Chemical Company, Limited, of Oosaka, Japan, when the hermetic seal is effected by the frit glass mass 20 outwardly or inwardly of the points of fixation.

What is claimed is:

1. In a flat display panel including a hermetically sealed envelope and being for use together with an external circuit disposed externally of said envelope for energizing said display panel, said display panel comprising a planar substrate formed of an insulating material as a part of said envelope and having an internal surface, a plurality of electrodes inside said envelope, and connection means for connecting said electrodes to said external circuit, said connection means comprising a plurality of conductive end pieces fixedly attached to said substrate and connected to predetermined ones of said electrodes, a plurality of elongated terminals conductively attached to said end pieces and extended outwardly of said envelope for connection to said external circuit, and fixing means fixing said terminals to said substrate at predetermined portions of the respective terminals, the improvement wherein:

each of said terminals comprises an internal conductor and a conductive lead; and said substrate is provided with a plurality of grooves substantially snugly receiving the respective conductive leads and having openings, respectively, on said internal surface, said internal conductors extending on said internal surface from said conductive end pieces into said grooves through the respective openings, said conductive leads including said predetermined portions.

2. A flat display panel as claimed in claim 1, wherein said grooves are provided with sloping end surfaces connecting the bottoms of said grooves with said internal surface and said internal conductive are extended partly along said sloping end surfaces, respectively.

3. A flat display panel as claimed in claim 2, wherein each of said sloping end surfaces forms an angle of at least about 135° with said internal surface.

4. A flat type display panel as claimed in claim 3, said conductive leads being placed in the respective grooves on those ends of said internal conductors which extend into said grooves along said sloping end surfaces.

5. A flat display panel as claimed in claim 4, wherein each of said terminals further comprises means for ensuring contact between said internal conductors and said conductive leads.

6. A flat display panel as claimed in claim 5, wherein said fixing means forms a part of said envelope.

7. A flat display panel as claimed in claim 5, wherein said fixing mean is positioned externally of said envelope.

8. A flat display panel as claimed in claim 5, wherein said fixing means is positioned internally of said envelope.

* * * * *